US007575481B1

(12) United States Patent
Liu

(10) Patent No.: US 7,575,481 B1
(45) Date of Patent: Aug. 18, 2009

(54) USB PLUG WITH A BUILT-IN-CARD-READING SLOT

(76) Inventor: Chen-Ya Liu, No. 27, Jhenchang Street, Pingjhen City, Taoyuan County 324 (TW)

( * ) Notice: Subject to any disclaimer, the term of this patent is extended or adjusted under 35 U.S.C. 154(b) by 0 days.

(21) Appl. No.: 12/318,310

(22) Filed: Dec. 24, 2008

(51) Int. Cl.
*H01R 24/00* (2006.01)

(52) U.S. Cl. ..... 439/660; 439/945

(58) Field of Classification Search ..... 439/76.1, 439/502, 629, 638, 660, 945
See application file for complete search history.

(56) References Cited

U.S. PATENT DOCUMENTS 7,329,153 B2 * 2/2008 Lin et al. ..... 439/660
7,354,314 B1 * 4/2008 Sprouse et al. ..... 439/660
7,407,390 B1 * 8/2008 Ni ..... 439/76.1
7,520,782 B1 * 4/2009 Huang ..... 439/638

* cited by examiner

*Primary Examiner*—Khiem Nguyen
(74) *Attorney, Agent, or Firm*—Rosenberg, Klein & Lee

(57) ABSTRACT

A USB plug with a built-in card-reading slot having a metal housing meeting the specification of a USB A-Type plug and an isolation substrate enclosed within the metal housing. A first slot in electric connection to a USB female plug is created at a first surface thereof. The thickness of partial portion of the isolation substrate is less than 1.2 mm such that a second slot for the insertion of a thin-type Micro SD/T-Flash memory card is formed between the second surface and the second wall. A plurality of metal terminals is positioned on the second surface for an electric connection to the memory card such that the second slot 46 is formed as a thin-type card-reading slot for the SD/T-Flash memory card. Moreover, an indentation is formed at the tail of the second wall for the insertion of the protrusion of the memory card such that the protrusion just fits into the indentation when the memory card is inserted into the second slot; moreover, the contour still meet the specification of the normal USB plug such that a normal USB operation won't be affected when the USB plug is attached to a terminal portion of an electronic product.

7 Claims, 10 Drawing Sheets

USB PLUG WITH A BUILT-IN-CARD-READING SLOT

BACKGROUND OF THE INVENTION

1. Field of the Invention

The invention relates to a USB plug with a built-in card-reading slot, and more particularly to an A-Type USB plug with a built-in card-reading slot. Moreover, the normal USB plug function is still fulfilled.

2. Description of the Related Art

Universal Serial Bus is referred to as USB. It has been developed and designed by many computer companies, such as Compaq, Intel, Microsoft, Digital Equipment, NEC, IBM and Nortel.

USB connector is a standard interface and unified the connectors of a variety of peripheral devices such that it is regarded as a "universal connector". With the development of electronics, communications and digital technologies, USB connector plays an indispensable role in the computer field.

FIG. 1 shows a perspective view of a transmission cable connector of a conventional USB plug. According to the specification of an A-Type USB plug, the external thickness t1 of the metal housing 11 is 4.52 mm while the thickness of an isolation substrate 12 enclosed by the metal housing 11 is approximately 1.5~2.0 mm such that the metal housing 11 internally creates a slot 13 in electric connection to a USB female plug (not shown). It is a pity that the conventional USB plug 10 only establishes an electric connection over a cable connector to another electronic product 80 and does not have other functions.

As new digital products continue to be introduced on the market, a variety of memory cards with different specifications and capacities has been developed, such as Micro SD and Mini SD that are a small and a large SD memory card, respectively. Since there are memory cards, card readers are needed and serve as an interface between the host computer and the memory card. The data transmission takes place by means of a USB jack in the host computer. However, most of the card readers on the current market have a large size. Compared with a small memory card, the card reader really occupies much space, thereby increasing much inconvenience in use.

As a result, a memory card reader 20, as shown in FIGS. 2A and 2B, is developed. A substrate 24 is received within a cavity 22 of a plug 21. A contact finger interface 25 is fitted to the front surface of the substrate 24 while conductive strips 26 are positioned at the rear surface thereof. In this way, a card-reading slot 23 (or a card reader) is formed at the tail thereof for the insertion of a memory card 27. The memory card 27 includes an access interface 28 that is electrically connected to the conductive strips 26. As a result, a smooth access of data is ensured when the plug 21 is connected to the computer. The memory card reader 20 has the advantages of light weight und thin structure. However, the card-reading slot 23 is disposed at the opposite side of the USB plug 21. Therefore, it can be used only as a card-reader, but it is not possible to fulfill other functions. This requires further improvements.

SUMMARY OF THE INVENTION

An object of the invention is to provide a USB plug with a built-in card-reading slot that skillfully makes use of the internal space of a USB plug for a practical arrangement of a built-in Micro SD/T-Flash memory such that the USB plug establishes an electric connection, permits a data transmission, and further serves as a Micro SD/T-Flash memory card reader. The difference of the invention from the conventional thin type card reader lies in that the USB plug may achieve other functions while the original function won't be affected due to this structural change.

Another object of the invention is to provide a USB plug with a built-in card-reading slot that is constructed as a USB flash drive having the card-reading function. In addition to an individual access of data in the USB flash drive or the memory card, a data access between them and a back-up copy are also achieved.

A further object of the invention is to provide a USB plug with a built-in card-reading slot that is constructed as a USB wireless TV-stick having the card-reading function. In addition to an individual access of data in the memory card, a back-up copy of the TV programs can be done as well.

Still another object of the invention is to provide a USB plug with a built-in card-reading slot that is constructed as a USB transmission cable connector having the function of the card-reader. In addition to an individual access of data in the memory card, an electric connection over the transmission cable connector to other electronic products, such as cellular phones, digital cameras, MP3/MP4, hand-held computer, GPS, PDA, Gameboy, etc., is established, thereby fulfilling different functions, such as memorizing, saving, charging, reading, displaying, data transmission, etc.

In order to achieve the above-mentioned objects, the invention includes:

a) a metal housing meeting the specification of USB A-Type plug dimensions and having a first wall and a second wall at the top and bottom ends thereof, respectively; and b) an isolation substrate enclosed by the metal housing except the front-rear side thereof, the isolation substrate having a first surface and a second surface, the first surface being directed downward and having a contact finger interface such that the first surface and the first wall of the metal housing create a first slot in electric connection to a USB female plug, wherein the thickness of partial portion of the isolation substrate is less than 1.2 mm such that a second slot for the insertion of a thin-type Micro SD/T-Flash memory card is formed between the second surface and the second wall;

wherein a plurality of metal terminals is positioned on the second surface for an electric connection to the memory card such that the second slot is formed as a thin-type card-reading slot for the SD/T-Flash memory card; and wherein an indentation is formed at the tail of the second wall for the insertion of the protrusion of the memory card such that the protrusion just fits into the indentation when the memory card is inserted into the second slot; moreover, the contour still meet the specification of the normal USB plug such that a normal USB operation won't be affected when the USB plug is attached to a terminal portion of an electronic product.

BRIEF DESCRIPTION OF THE DRAWINGS

The accomplishment of this and other objects of the invention will become apparent from the following descriptions and its accompanying figures of which.

DETAILED DESCRIPTION OF THE PREFERRED EMBODIMENT

Figure 1:
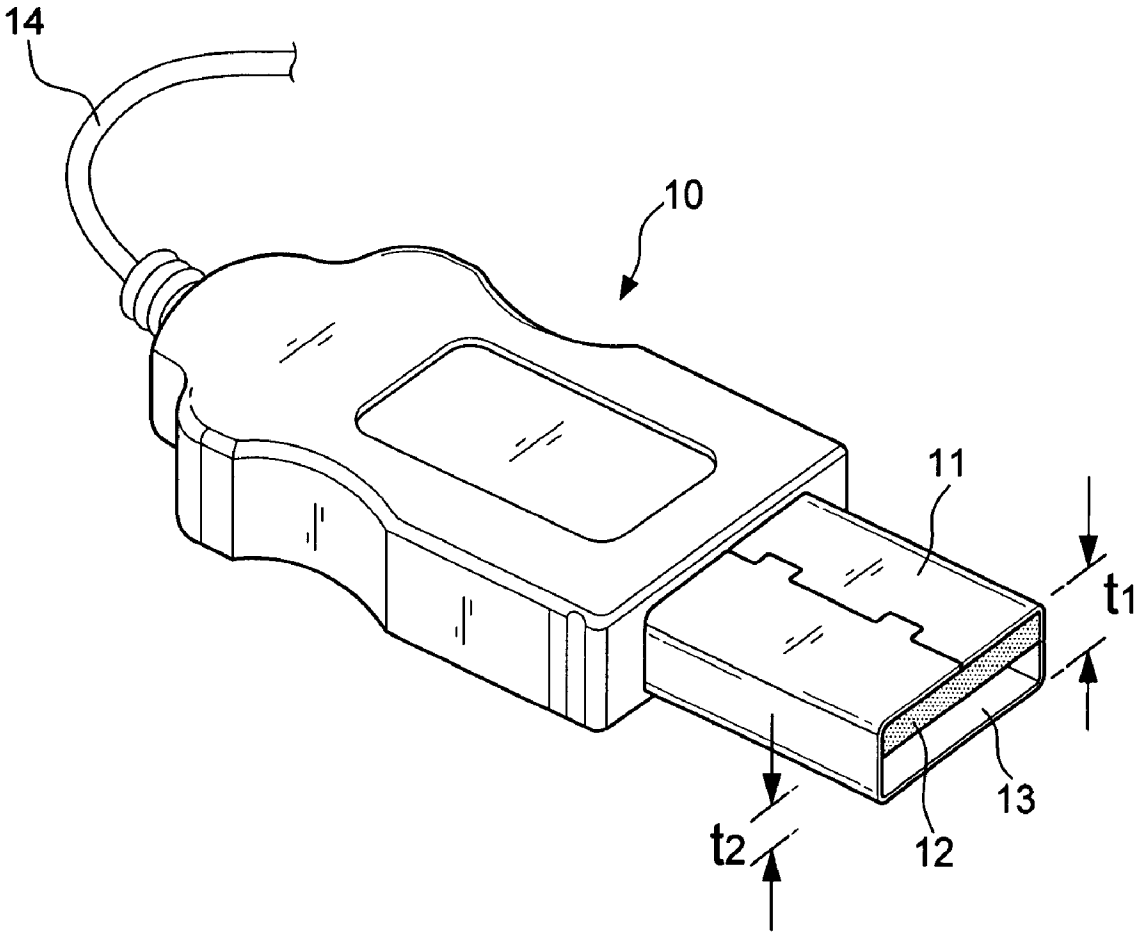
FIG.1 PRIOR ART
FIG. 1 is a perspective view of a conventional USB plug.
Figure 2B:
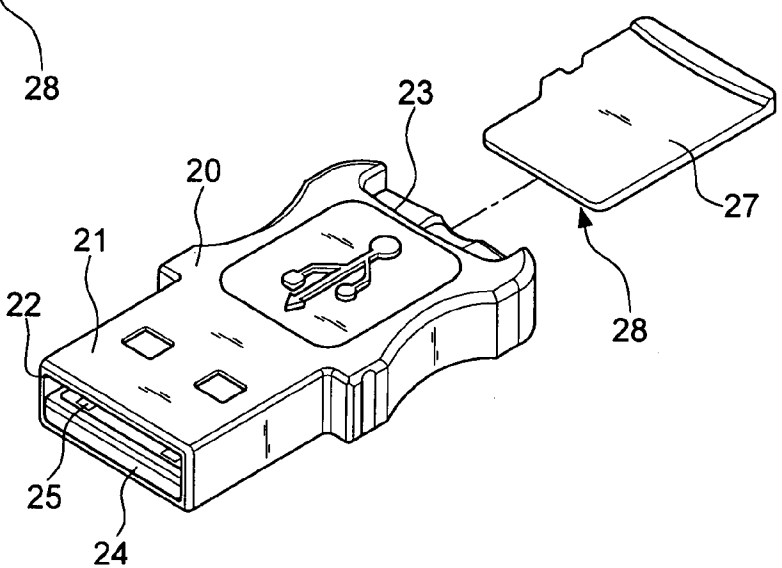
FIG.2B PRIOR ART
FIGS. 2A and 2B are perspective views of a conventional USB card reader in a disassembly and assembly position, respectively.
Figure 2A:
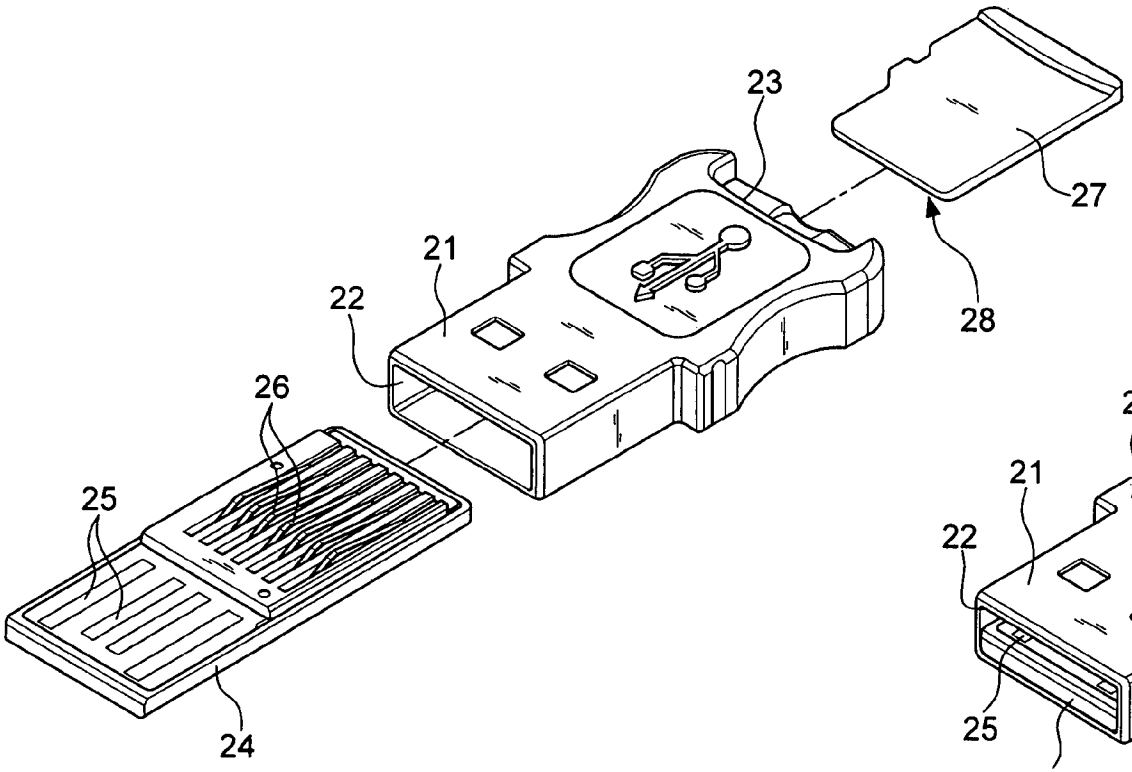
FIG.2A PRIOR ART
Figure 3:
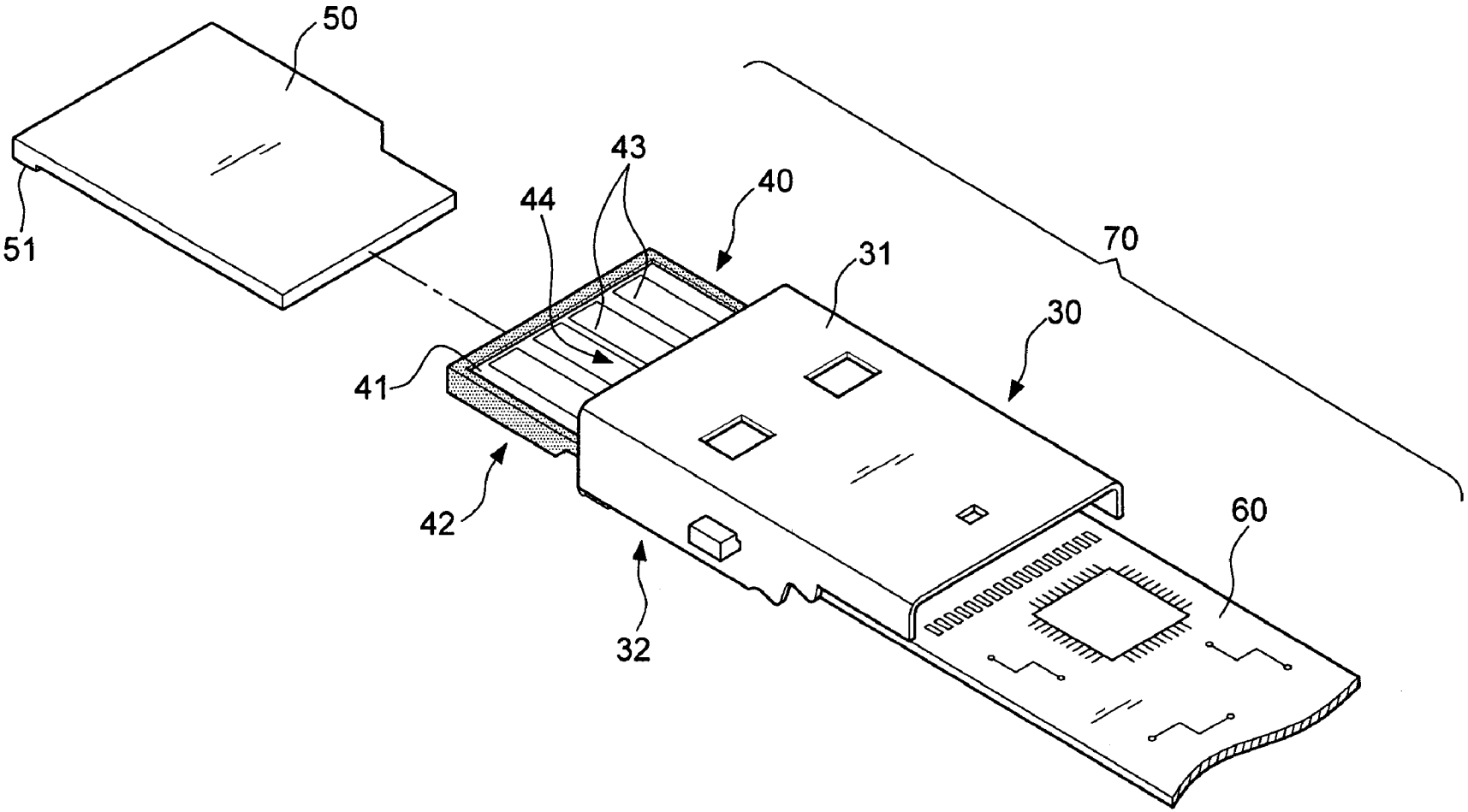
FIG. 3 is a perspective view of the invention in a half-disassembly position, showing the first wall directed upward.
Figure 4:
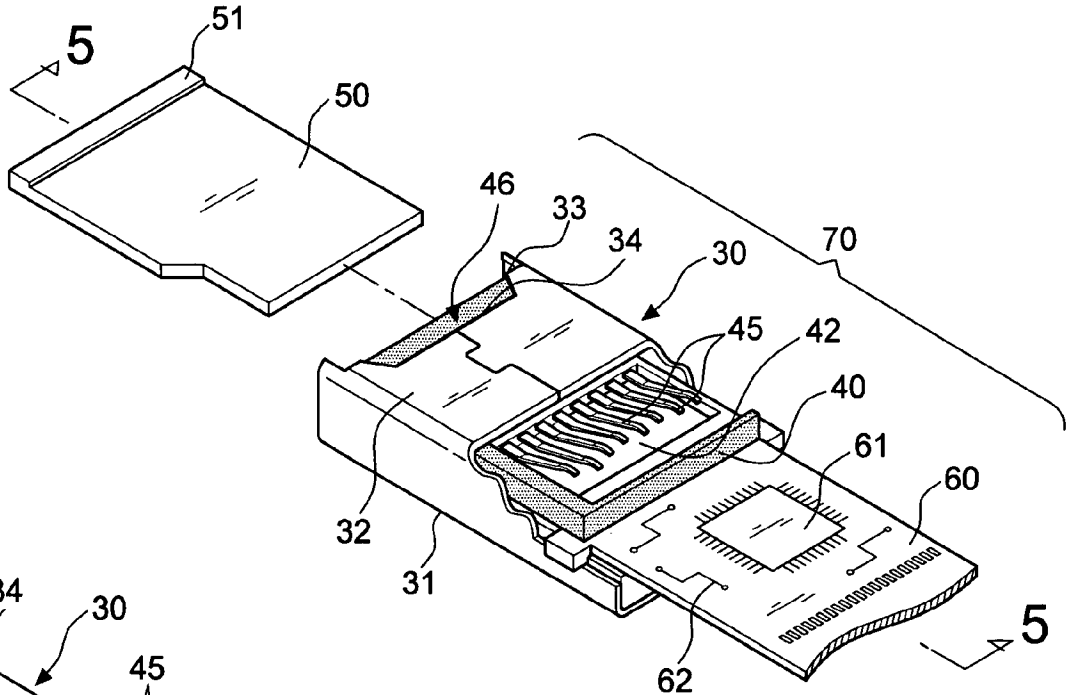
FIG. 4 is a perspective view of the invention in a half-disassembly position, showing the first wall directed downward.
Figure 5:
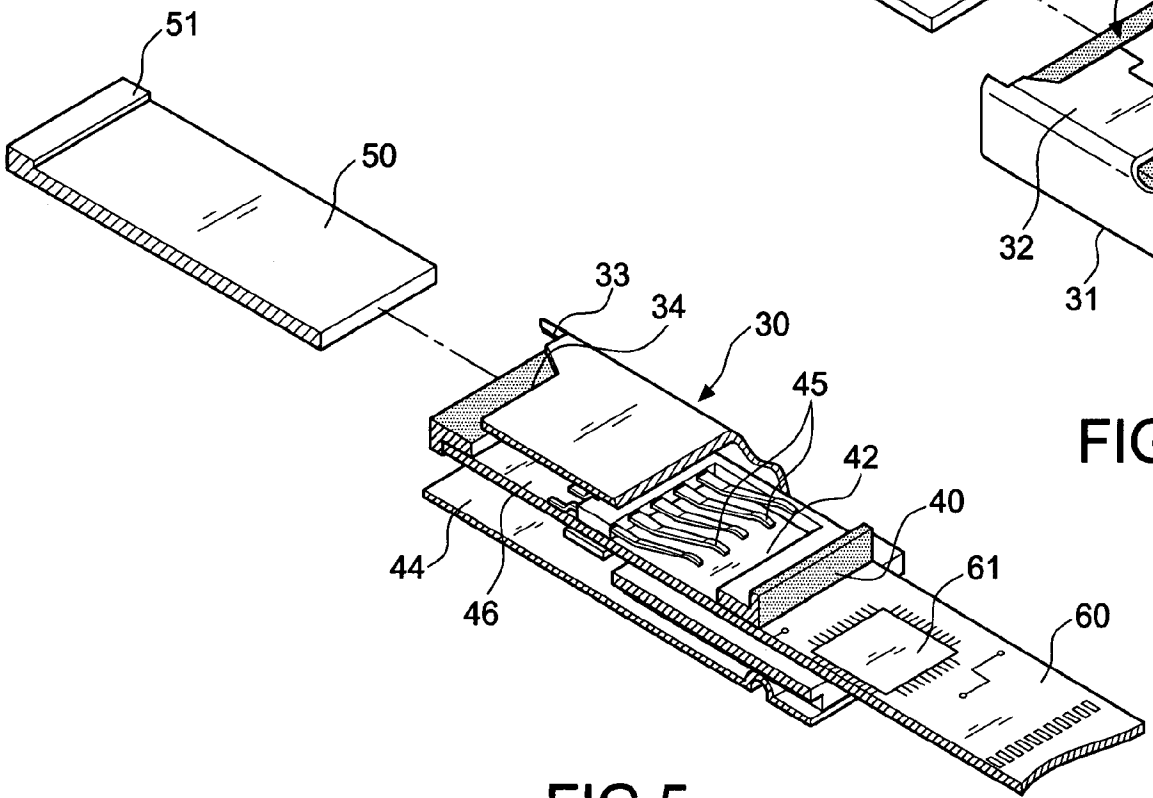
FIG. 5 is a cutaway view taken along line 5-5 of FIG. 4.
Figure 6:
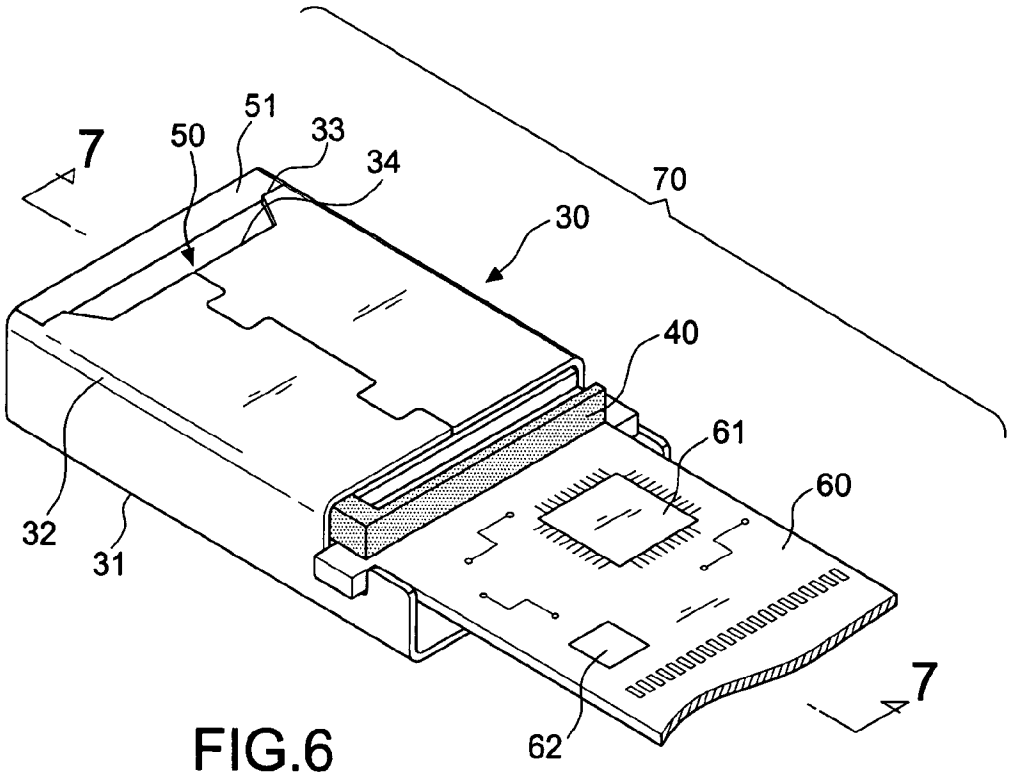
FIG. 6 is a perspective view of the invention in an assembly position.
Figure 7:
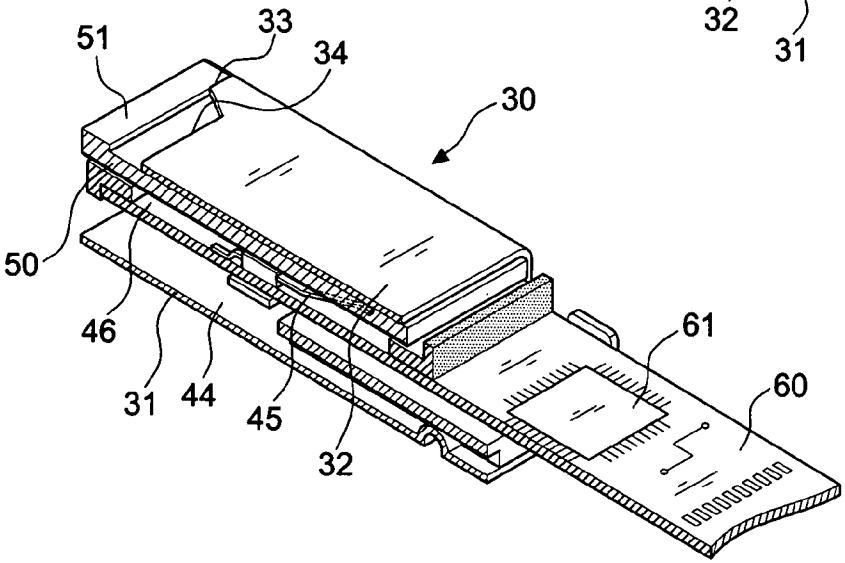
FIG. 7 is a cutaway view taken along line 7-7 of FIG. 6.
Figure 8:
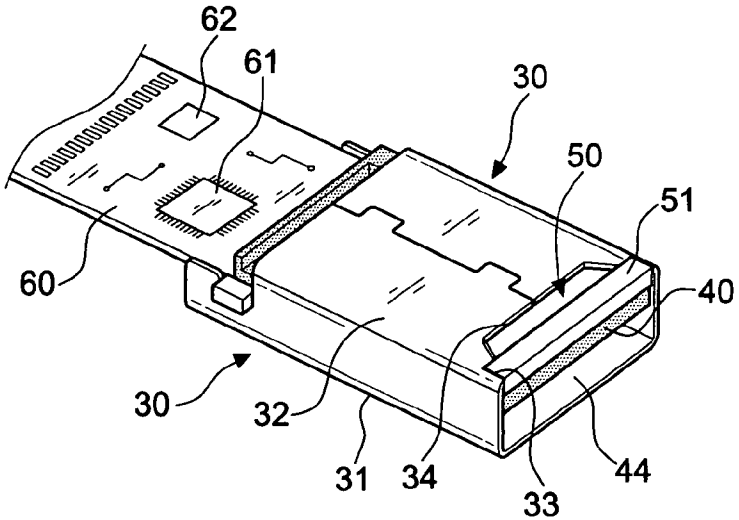
FIG. 8 is a perspective view of the invention seen from another direction.
Figure 9:
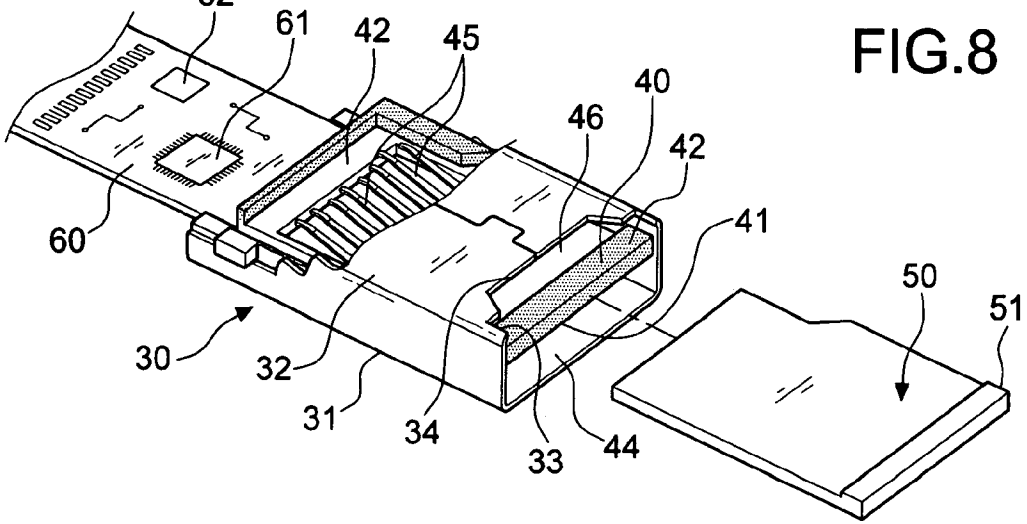
FIG. 9 is a perspective view of the invention in an assembly position seen from another direction.

First of all, referring to FIGS. 3 through 10, a USB plug 70 in accordance with the invention is an A-Type USB plug having dimensions of 12 mm (length), 12.05 mm (width), and 4.52 mm (height) for the arrangement of a thin type built-in card-reading slot for Micro SD/T-Flash memory card without affecting the normal operation of the USB plug 70. In order to achieve the prearranged effects in the limited space, a preferred embodiment of the invention includes a metal housing 30 and an isolation substrate 40.

The metal housing 30 meets the specification of USB A-Type plug dimensions and includes a first wall 31 and a second wall 32 at the top and bottom ends thereof, respectively. The first wall 31 is the upward side of the USB plug 70 in normal operation position while the second wall 32 is the downward side thereof. However, the first wall 31 is illustrated in a downward position for an easy description except the first wall 31 shown in a normal upward position only in FIG. 3.

The isolation substrate 40 is enclosed by the metal housing 30 except the front-rear side thereof and includes a first surface 41 and a second surface 42. The first surface 41 is directed downward and includes a contact finger interface 43 such that the first surface 41 and the first wall 31 of the metal housing 30 create a first slot 44 in electric connection to a USB female plug (not shown). The above-mentioned structure belongs to that of the conventional USB plug so that no further descriptions thereto are given hereinafter.

The invention features that the original isolation substrate 40 is thinned. For example, the original thickness thereof is 1.5~2.0 mm. The second surface 42 of the contact finger interface 43 is so thinned that the thickness is less than 1.2 mm. In this way, a second slot 46 for the insertion of a thin-type Micro SD/T-Flash memory card 50 is formed between the second surface 42 and the second wall 32. Moreover, a plurality of metal terminals 45 is positioned on the second surface 42 for an electric connection to the memory card 50. As a result, the second slot 46 is regarded as thin-type card-reading slot for the SD/T-Flash memory card.

The normal thin-type Micro SD/T-Flash memory card 50 includes a protrusion 51 at the tail thereof for an easy grip with the finger. Therefore, another feature of the invention lies in that an indentation 33 is formed at the tail of the second wall 32 for the insertion of the protrusion 51 of the memory card 50. In this way, the protrusion 51 just fits into the indentation 33 when the memory card 50 is inserted into the second slot 46. Thus, the contour still meet the specification of the normal USB plug such that a normal USB operation won't be affected when the USB plug 70 is attached to a terminal portion of an electronic product (no matter if the memory card 50 is inserted or not).

Moreover, a recessed portion 34 is positioned at the bottom of the indentation 33 of the metal housing 30. As a result, a space for an easy removal of the memory card 50 with the finger is created between the recessed portion 34 and the protrusion 51.

In addition, a circuit board 60 is integrally formed or mounted at the tail of the isolation substrate 40 of the USB plug 70. Of course, the circuit board 60 is electrically connected to the contact finger interface 43 at the first surface 41 and the metal terminals 45 at the second surface 42 such that the normal functions of the USB plug and the card reader are achieved. In other words, the circuit board 60 is provided with a control circuit for the card-reading purpose. However, this integrated circuit (IC) is not the object of the invention so that no further descriptions thereto are given hereinafter.

Figure 10:
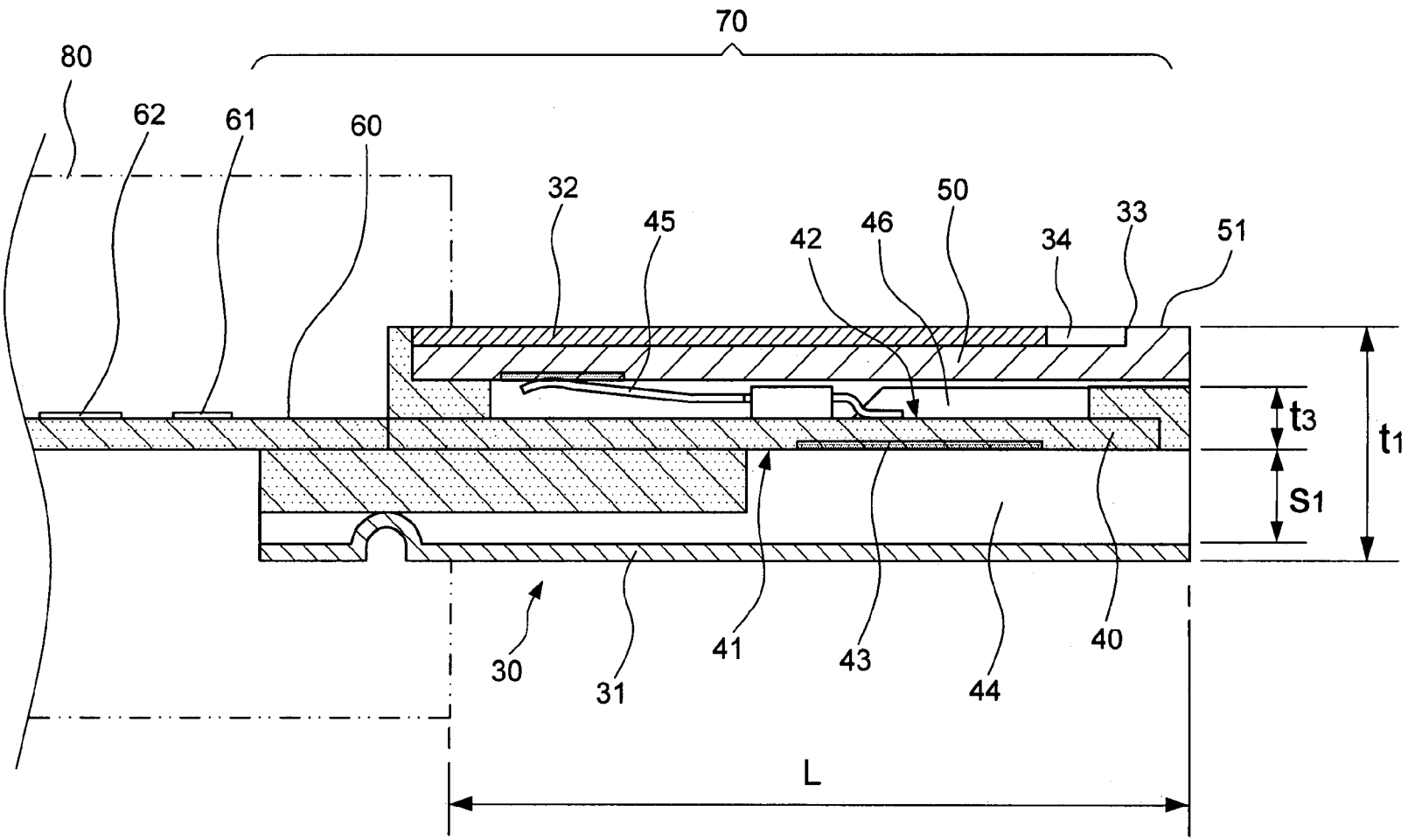
FIG. 10 is a cutaway view of the invention.
Figure 11:
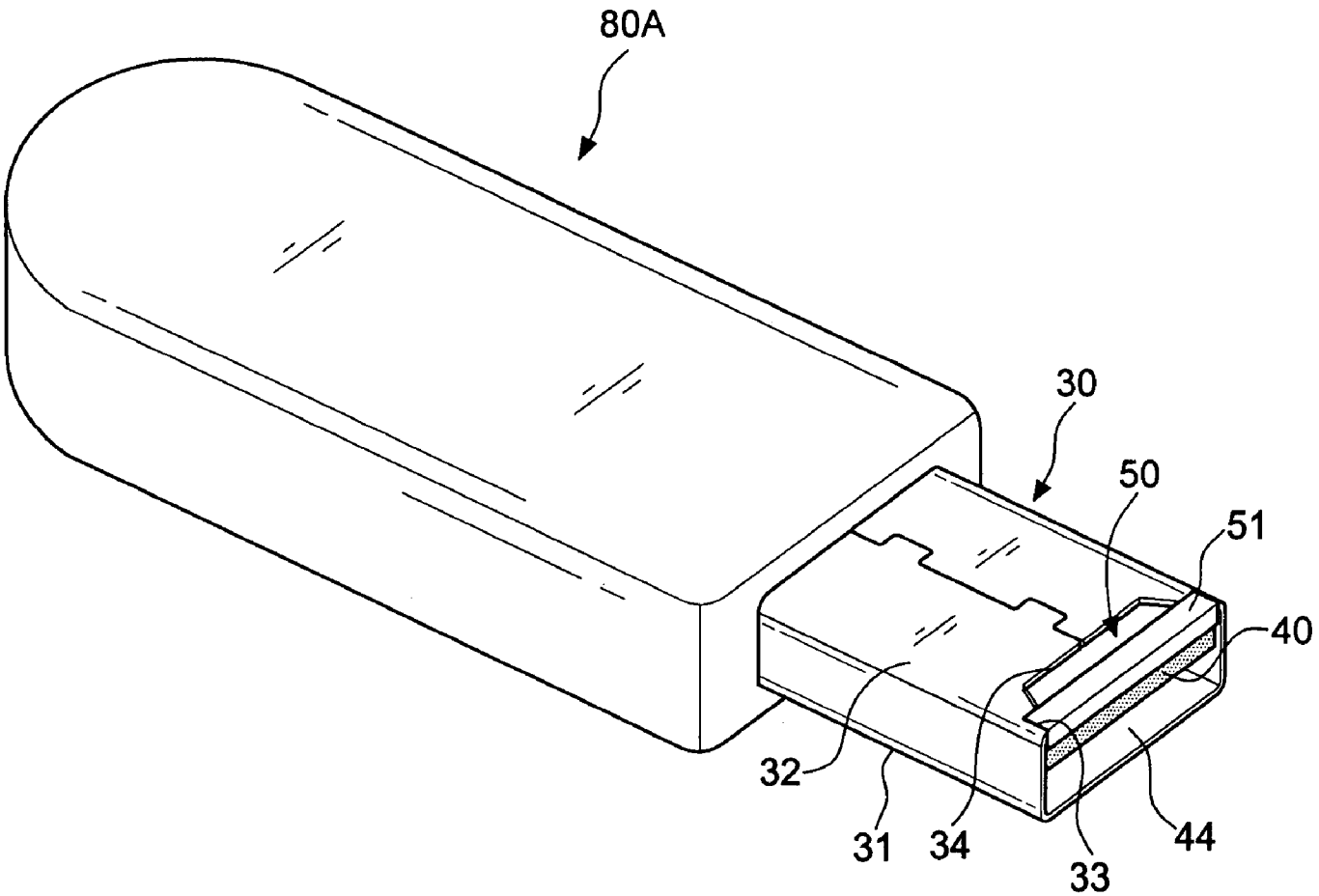
FIG. 11 is a perspective view of the invention constructed as a USB flash drive.
Figure 12:
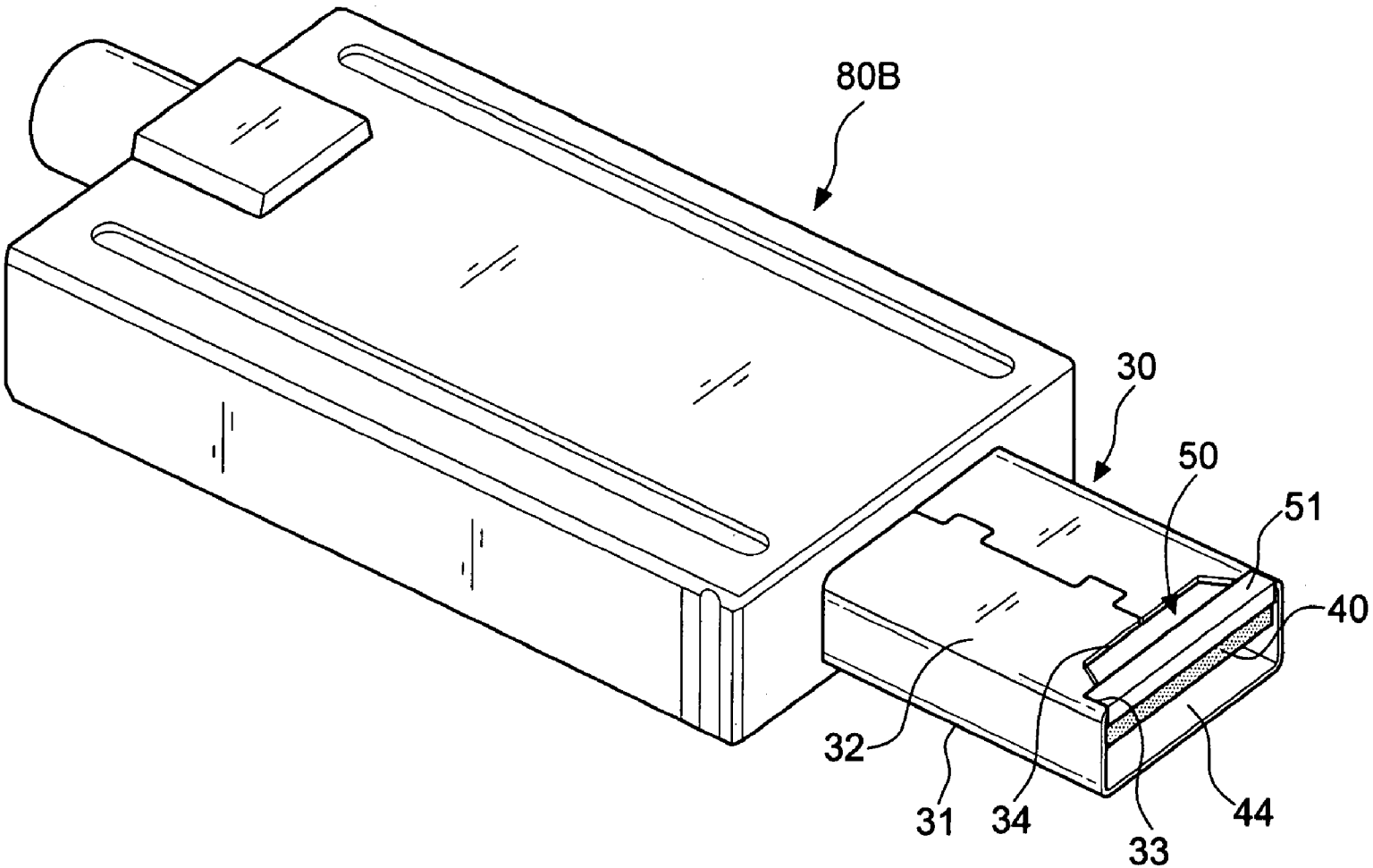
FIG. 12 is a perspective view of the invention constructed as a USB wireless TV stick.
Figure 13:
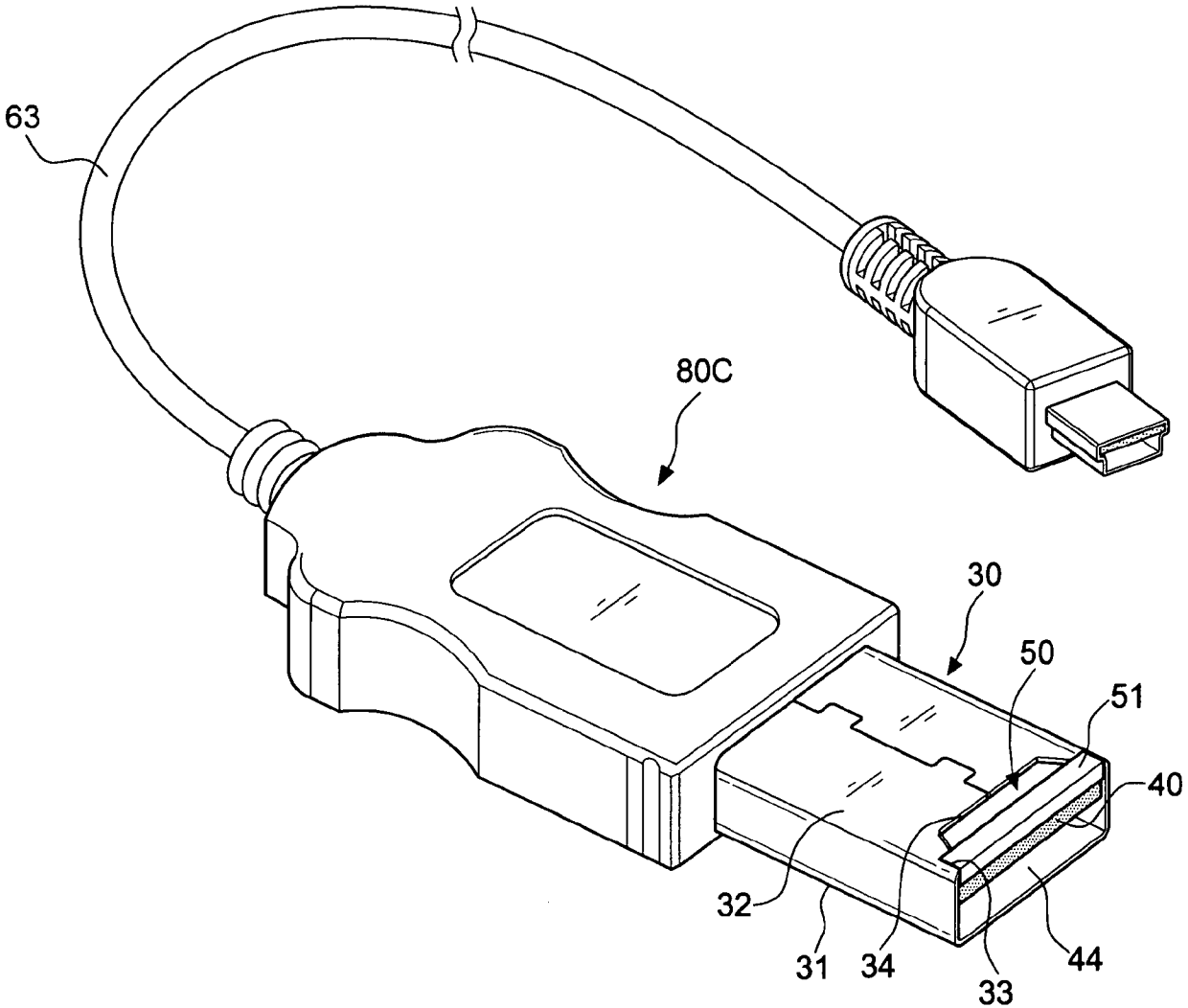
FIG. 13 is a perspective view of the invention constructed as a USB transmission cable connector 63.

As shown in FIG. 10, the USB plug 70 is attached to a certain electronic product 80. For example, the circuit board 60 includes a flash memory 61 so that a USB flash drive 80A having the card-reading function is created. In addition to an individual access of data in the USB flash drive or the memory card, a data access between them and a back-up copy are also achieved. Besides, the circuit board 60 includes a receiving circuit 62. As shown in FIG. 12, a USB wireless TV-stick 80B having the card-reading function is created. In addition to an individual access of data in the memory card, a back-up copy of the TV programs can be done as well. As shown in FIG. 13, the circuit board 60 is connected with a transmission cable connector 63 such that a USB transmission cable connector 80C having the function of the card-reader is created. In addition to an individual access of data in the memory card, an electric connection over the transmission cable connector to other electronic products, such as cellular phones, digital cameras, MP3/MP4, hand-held computer, GPS, PDA, Gameboy, etc., is established, thereby fulfilling different functions, such as memorizing, saving, charging, reading, displaying, data transmission, etc. The above-mentioned are only a few examples of the possible application of the invention. Moreover, the USB plug 70 of the invention is also applicable to proper electronic products, such as cellular phones, digital cameras, MP3/MP4, hand-held computer, GPS, PDA, Gameboy, etc. for fulfilling different functions, such as memorizing, saving, charging, reading, displaying, data transmission, etc.

Referring back to FIG. 10, the USB plug of the invention features that the original specification and the internal functions of the USB plug stay unchanged such that it can be used in combination with all kinds of the electronic products 80. In other words, the exposed length L of the metal housing 30 stays unchanged at 12 mm while the thickness t1 still remains at 4.52 mm. Moreover, the gap S1 of the first slot 44 remains unchanged, too. The change takes place only at the thickness t3 of the isolation substrate 40 for creating the second slot 46 in which the thin-type Micro SD/T-Flash memory card 50 is insertable. However, the reduction of the thickness does not affect the original function of the USB plug. Moreover, the metal terminals 45 are positioned at the second surface 42 for fulfilling the card-reading function. In addition, the indentation 33 is provided for the insertion of the protrusion 51 of the memory card. Therefore, it won't be exposed outside the USB plug 70. The limited space is fully employed so that the USB plug with a built-in card-reading slot in accordance with the invention is really a practical electronic product 80.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A USB plug with a built-in card-reading slot, and more particularly, an A-Type USB plug with a built-in card-reading slot, comprising:

a) a metal housing meeting the specification of USB A-Type plug dimensions and having a first wall and a second wall at the top and bottom ends thereof, respectively; and b) an isolation substrate enclosed by the metal housing except the front-rear side thereof, the isolation substrate having a first surface and a second surface, the first surface being directed downward and having a contact finger interface such that the first surface and the first wall of the metal housing create a first slot in electric connection to a USB female plug, wherein the thickness of partial portion of the isolation substrate is less than 1.2 mm such that a second slot for the insertion of a thin-type Micro SD/T-Flash memory card is formed between the second surface and the second wall;

wherein a plurality of metal terminals is positioned on the second surface for an electric connection to the memory card such that the second slot is formed as a thin-type card-reading slot for the SD/T-Flash memory card; and wherein an indentation is formed at the tail of the second wall for the insertion of the protrusion of the memory card such that the protrusion just fits into the indentation when the memory card is inserted into the second slot; moreover, the contour still meet the specification of the normal USB plug such that a normal USB operation won't be affected when the USB plug is attached to a terminal portion of an electronic product.

2. The USB plug with a built-in card-reading slot as recited in claim 1 wherein the indentation includes a recessed portion.

3. The USB plug with a built-in card-reading slot as recited in claim 1 wherein the thin-type memory card includes a Micro SD/T-Flash memory card.

4. The USB plug with a built-in card-reading slot as recited in claim 1 wherein a circuit board is positioned at the tail of the isolation substrate of the USB plug, and wherein, the circuit board is electrically connected to the contact finger interface at the first surface and the metal terminals at the second surface.

5. The USB plug with a built-in card-reading slot as recited in claim 4 wherein the circuit board includes a flash memory 61 so that a USB flash drive having the card-reading function is created.

6. The USB plug with a built-in card-reading slot as recited in claim 4 wherein the circuit board includes a receiving circuit so that a USB wireless TV-stick having the card-reading function is created.

7. The USB plug with a built-in card-reading slot as recited in claim 4 wherein the circuit board is connected with a transmission cable connector so that a USB transmission cable connector having the function of the card-reader is created.

* * * * *